United States Patent [19]

Hwang

[11] Patent Number: 4,884,416

[45] Date of Patent: Dec. 5, 1989

[54] ELECTRONIC AIR-CLEANING AIR CONDITIONER AUTOMATICALLY WASHED BY WATER

[76] Inventor: Min-Su Hwang, P.O. Box 10160, Taipei, Taiwan

[21] Appl. No.: 291,666

[22] Filed: Dec. 29, 1988

[51] Int. Cl.[4] ..... F28G 9/00

[52] U.S. Cl. ..... 62/303; 62/305; 165/95; 55/318

[58] Field of Search ..... 55/101, 108, 117, 122, 55/279, 315, 316, 318, 102; 62/305, 311, 303; 165/95

[56] References Cited

U.S. PATENT DOCUMENTS 3,846,072 11/1974 Patterson ..... 55/102

*Primary Examiner*—Henry Bennett

[57] ABSTRACT

An air conditioner includes an inside air cleaner provided in a front portion of the air conditioner for cleaning air inside a room circulated through the evaporator, and an outside air dust remover provided in a rear portion of the conditioner for precluding the entrance of dust laden in the air into the rear portion of the conditioner and for washing the condenser by spraying condensate water onto the condenser as collected from the conditioner bottom plate.

7 Claims, 8 Drawing Sheets

ELECTRONIC AIR-CLEANING AIR CONDITIONER AUTOMATICALLY WASHED BY WATER

BACKGROUND OF THE INVENTION

After a long time service of a room air conditioner, the evaporator, the condenser, and especially the heat-exchanging fins of the conditioner may be accumulated with dusts to reduce a cooling effect or air conditioning effect of the conditioner. The evaporator fins may also grow or spread bacteria or fungi under high moisture content in a conditioner, which may grow mildew and emit a stink odor, hazardous to human health.

The present inventor has found the drawbacks of a conventional air conditioner and invented the present aircleaning air conditioner.

SUMMARY OF THE INVENTION

The object of the present invention is to provide an air conditioner having an inside air cleaning means provided in a front portion of the air conditioner for cleaning air inside a room circulated through the evaporator, and an outside air dustremoving means provided in a rear portion of the conditioner for precluding the entrance of dust laden in the air into the rear portion of the conditioner and for washing the condenser by spraying condensate water onto the condenser as collected from the conditioner bottom plate.

DETAILED DESCRIPTION

Figure 1:
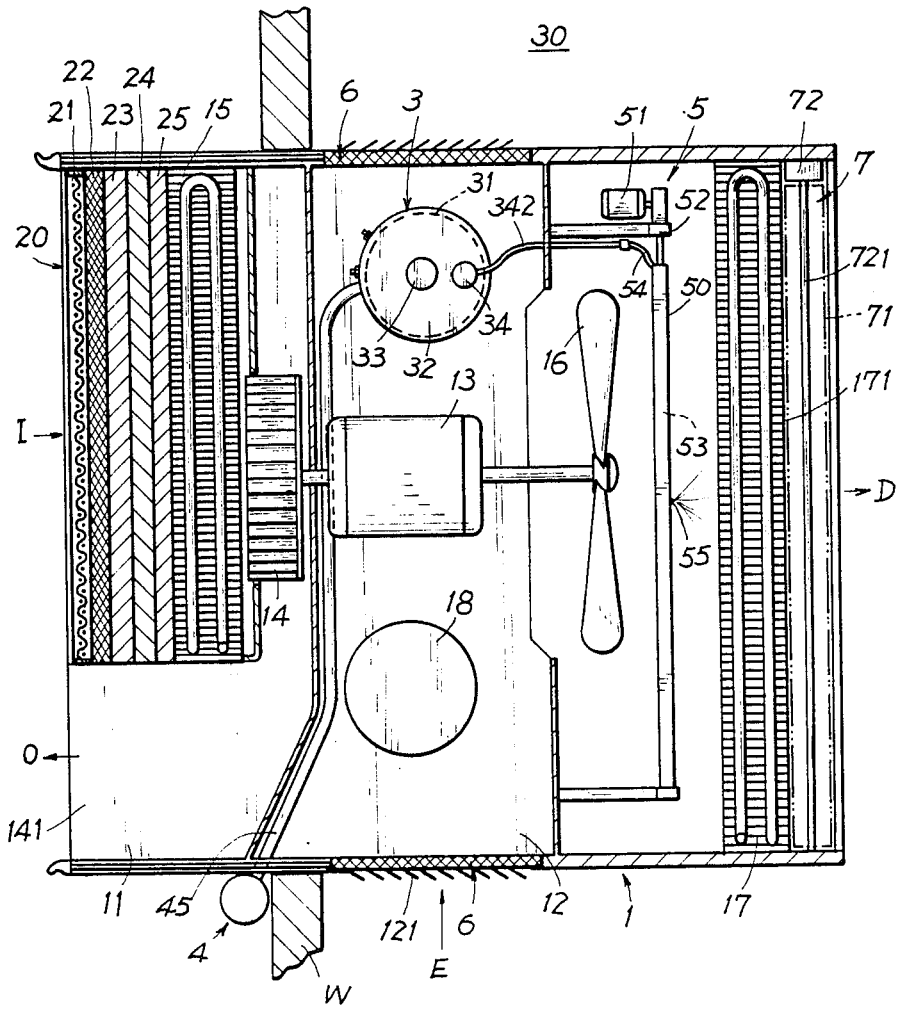
FIG. 1 is a top-view illustration of the present invention.

As shown in FIGS. 1–6, the present invention comprises: an air conditioner set 1 having a front portion 11 installed inside a room or interior and a rear portion 12 protruding rearwardly from the front portion 11 to outdoors as partitioned from the front portion 11 by a wall W, an inside air cleaning means 20 provided in the front portion 11 of the conditioner set 1, and an outside air dusting-removing means 30 provided in the rear portion 12 of the set 1. The L-shaped bottom frame 100 is provided with rollers or beads 101 for a convenient sliding installation of the conditioner 1 on a mounting frame.

Figure 2:
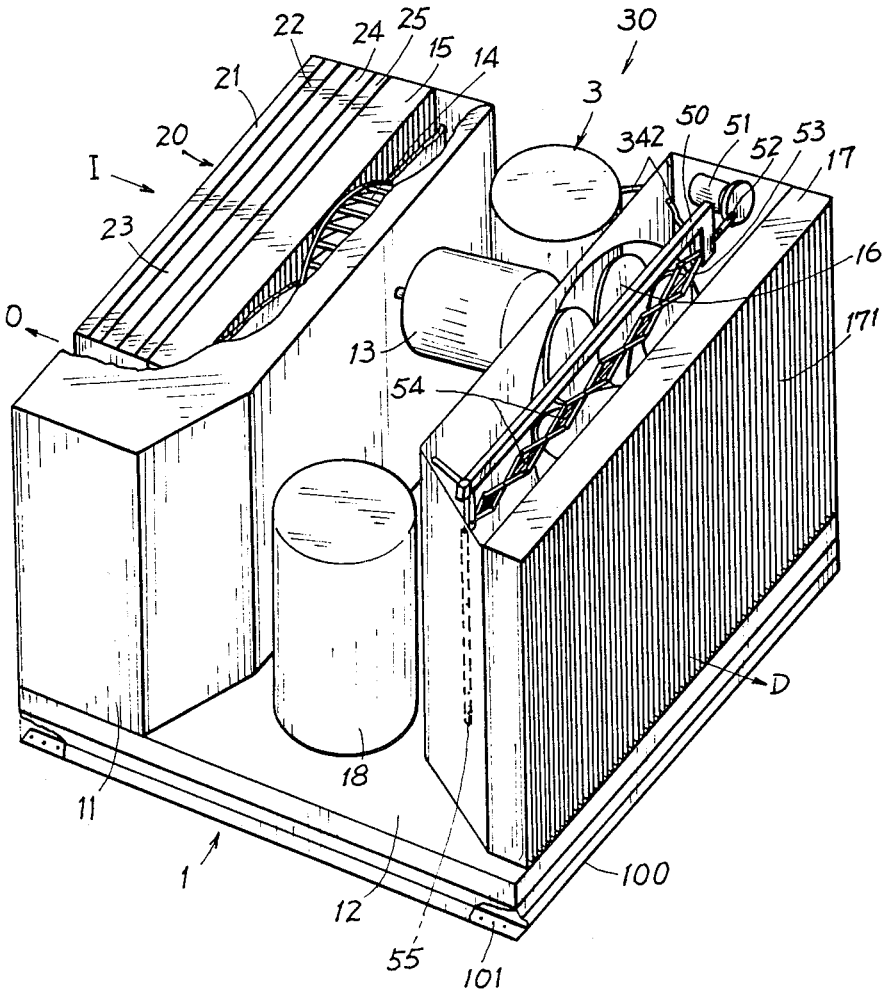
FIG. 2 is a perspective illustration of the present invention.

The inside air cleaning means 20 includes: a screen 21 formed on a front portion beyond the evaporator 15 in the front portion 11 for primarily filtering coarse dust particles laden in the air inside a room as sucked in direction I, a non-woven cloth filter 22 formed on a rear side of the screen 21 for secondarily filtering off fine dust particles in the air, an electrostatic precipitator 23 formed on a rear side of the cloth filter 22 for electrically precipitating finer particles which are positively charged as ionized by a high voltage discharging current and attracted to the negative electrodes of the precipitator 23 , an oxygen ion producer 24 capable of producing millions of oxygen anions per second which are helpful for human health and also for cleaning air secured on a rear side of the electrostatic precipitator 23, and an activated-carbon filter 25 formed between the oxygen ion producer 24 and a blower 14 driven by a fan motor 13 as shown in FIGS. 1 and 2 for deodorizing the dust-removed air or hazardous gases passing through the inside air cleaning means 20. The high tension ionization process in the electroprecipitator 23 and in oxygen ion producer 24 may kill bacteria as laden in the air.

The air enterring through the air cleaning means 20 (direction I) as sucked by the blower 14 is filtered off the dust particles, bacteria, fungi, stink odor, vapor, gas, fume and then blown into the room from the discharge port 141 in direction O for supplying a dust-free, deodorized, clean air for comfortable and healthy human breathing.

The outside air dust-removing means 30 includes: a water accumulator 3, a detergent supplier 4, a water spraying means 5, a side filter means 6, and a rear rolling shield 7.

Figure 4:
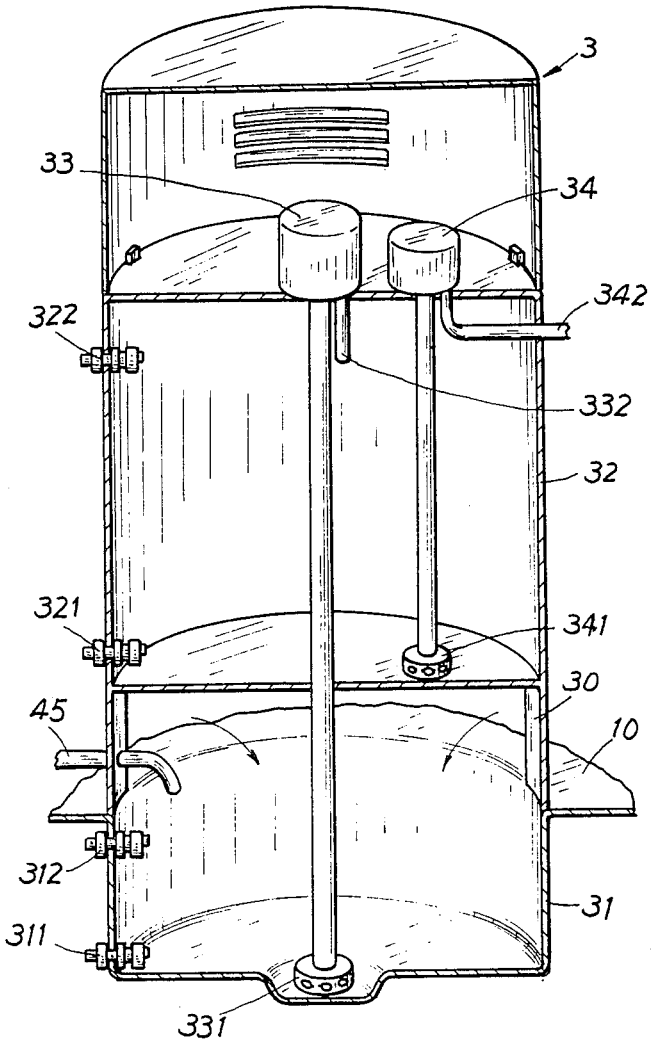
FIG. 4 is an illustration showing a water accumulator of the present invention.

The water accumulator 3 as shown in FIG. 4 includes a lower reservoir 31 recessed in a bottom plate 10 of the rear portion 12 for collecting the condensate water as condensed by the evaporator 15, and an upper tank 32 formed on the bottom plate 10 above the lower reservoir 31 by brackets 30.

The lower reservoir 31 is formed a low-level controller 311 and a high-level controller 312 in the reservoir. The upper tank 32 is provided with a first pump 33 having a suction pipe 331 poking into a bottom of the lower reservoir for pumping condensate water, collected in the reservoir 31 when the water reaches the high-level controller 312, into the upper tank 32; and a second pump 34 having a low-level controller 321 and a high-level controller 322, and a suction pipe 341 poking into a buttom of the tank 32 for pumping water outwardly through a discharge pipe 342 when the water reaches a high-level controller 322 provided in the tank 32.

Figure 5:
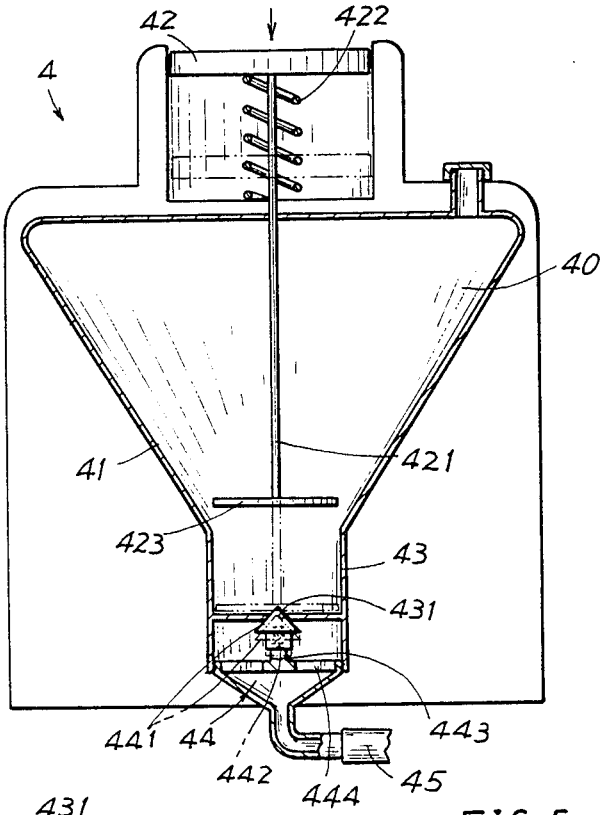
FIG. 5 is an illustration showing a detergent supplier of the present invention.
Figure 5A:
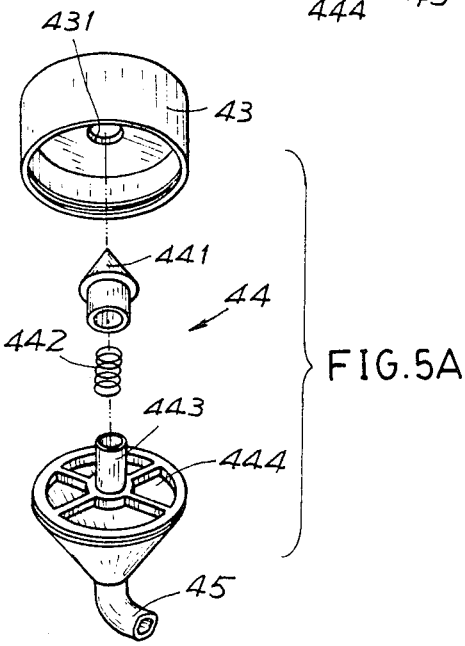
FIG. 5A is an illustration showing the elements in construction of the discharge valve of the present invention.

The detergent supplier 4 as shown in FIGS. 5, 5A includes: a detergent container 41 filled with detergent liquid 40 and fixed in the front portion 11 so that anyone can operate it at a room interior, a push button 42 having a stem 421 terminated with a pusher plate 423 protruding downwardly from the button 42 and normally restored upwardly by a spring 422 formed on an upper portion of the container 41, a drain hopper 43 formed on a lower portion of the container 41, and a discharge valve 44 formed on a bottom of the hopper 43, and a delivery pipe 45 for delivering detergent into the lower reservoir 31 of the water accumulator 3.

The discharge valve 44 of the detergent supplier 4 includes a plug 441 normally sealing a central hole 431 formed in a central bottom portion of the hopper 43, a lower spring 442 normally tensioning the plug 441 upwardly for sealing the hole 431, and a plug retainer 443 formed under the hopper 43 for resiliently holding the plug 441 and having drain holes 444 for discharging detergent into the pipe 45 when downwardly depressing the push button 42 to lower the stem 421 and the pusher plate 423 to depress the plug 431 to open the hole 431 as shown in dotted line of FIG. 5.

Figure 6:
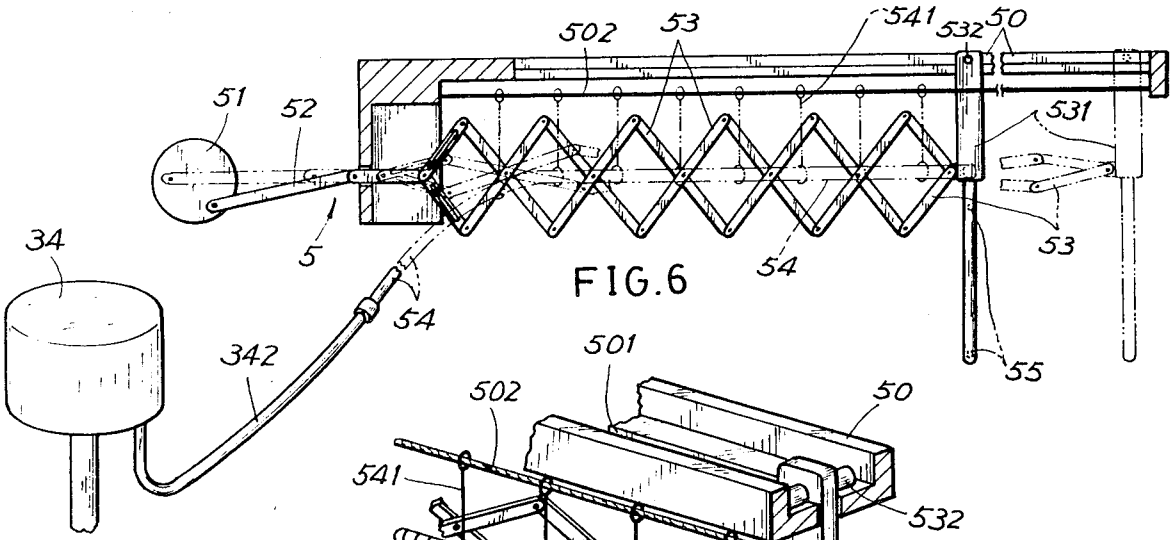
FIG. 6 shows a water spraying means of the present invention.
Figure 6A:
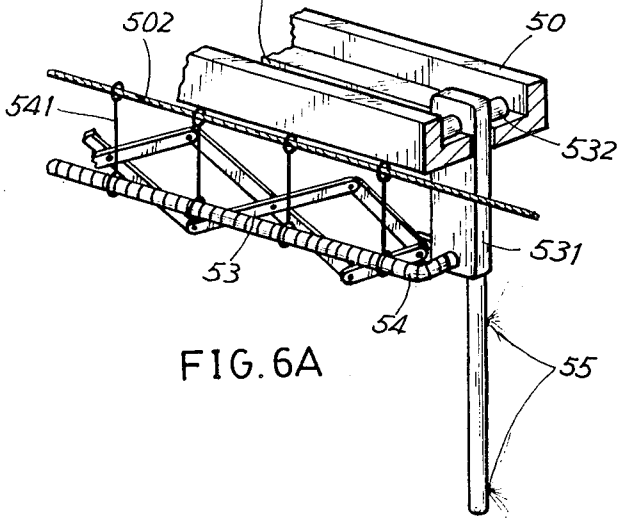
FIG. 6A is a partial perspective view of the water spraying means of the present invention.

The water spraying means 5 as shown in FIGS. 6, 6A includes: a reciprocating means 53 having a telescopic link assembly driven by a speed-reducing motor 51 to reciprocate horizontally by a crank 52 pivotally connected between the motor 51 and the means 53, a flexible water hose 54 connected to the discharge pipe 342 slidably hanged under a rail means 50, and at least a nozzle 55 terminated on an outermost end of the water hose 54 secured to a slider block 531 having rollers 532 rolling on a first rail 501 of the rail means 50. The hose 54 is slidably hanged to a second rail 502 of the rail means 50 by a plurality of hangers 541.

Figure 3:
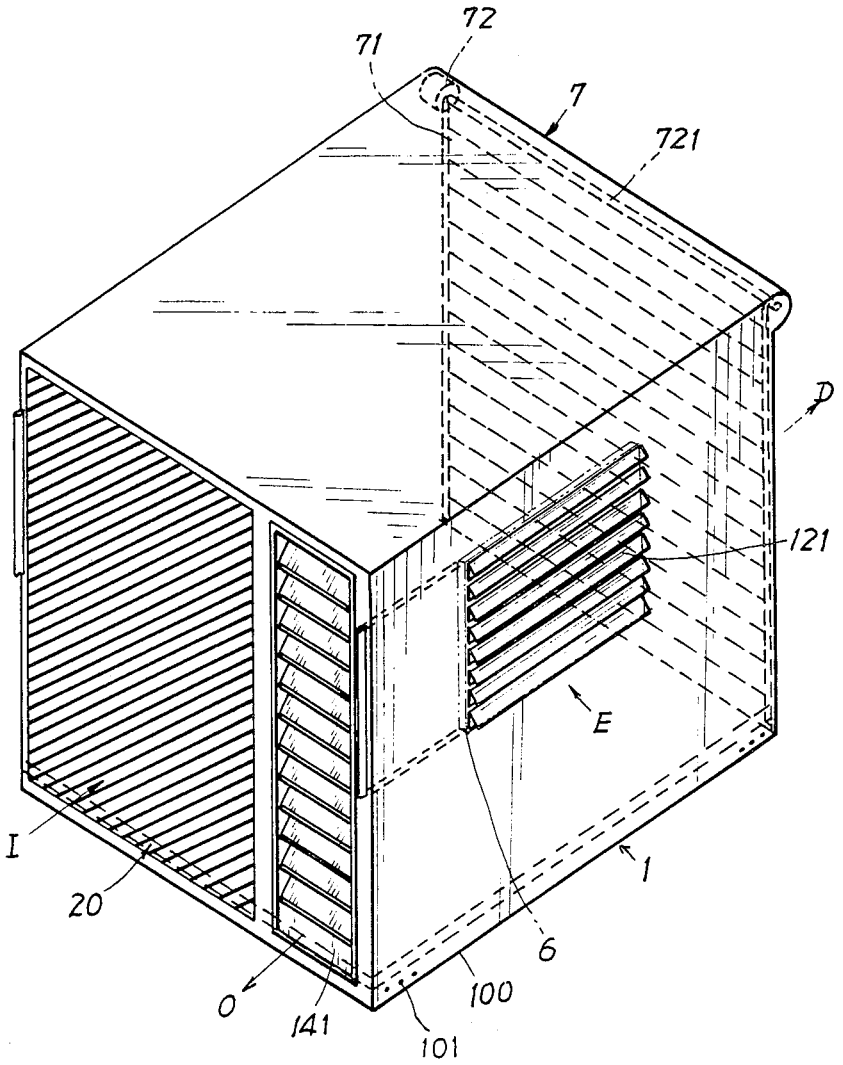
FIG. 3 is an illustration showing an outer appearance of the present invention.

The side filter means 6 as shown in FIGS. 1, 3 includes a pair of air filters such as a filter cloth or any other filters each secured to a side louver window 121 for filtering dust laden in an environmental air when sucked into the rear portion 12 by the condenser fan 16 to prevent the dust accumulation on the condenser fins. The filters 6 can be detachably withdrawn from the front portion 11 of the conditioner for their maintenance.

The rear rolling shield 7 includes a flexible shield 71 and a rear speed-reducing motor 72 having a spindle 721 rotatably wound by the shield 71 so that the shield 71 can be unrolled to close a rear discharge port 171 of the air conditioner for precluding air pollutants or dusts when the conditioner is not running.

In operating the outside air dust-removing means 30, the condensate water as collected in the lower reservoir 31 is pumped to the upper tank 32 to accumulate quantity of water enough for a minimum spray operation for washing the condenser 17. When the water level reaches the high-level controller 322 of the uppper tank 32, the second pump 34 is started to pump water through pipe 342, hose 54 and nozzles 55 to flush the condenser and its fins and the motor 51 is also electrically actuated by the high-level controller 322 to start its rotation for reciprocatively moving the reciprocating means 53 to reciprocate the nozzles 55 horizontally for better cleaning of the condenser 17. The dusts still accumulated on the condenser 17 are washed by the flushing water from the water spraying means 5, wherein the water is inclinedly sprayed to the condenser fins and the dust-laden water is then drained through a drain hose connected to the set 1.

Meanwhile, the water as sprayed onto the condenser fins will absorb condensation heat as emitted from the condensing refrigerant compressed by a compressor 18 to further cool down the refrigerant, besides the air cooling by the fan 16, resulting in a better cooling effect for the conditioner.

Figure 7:
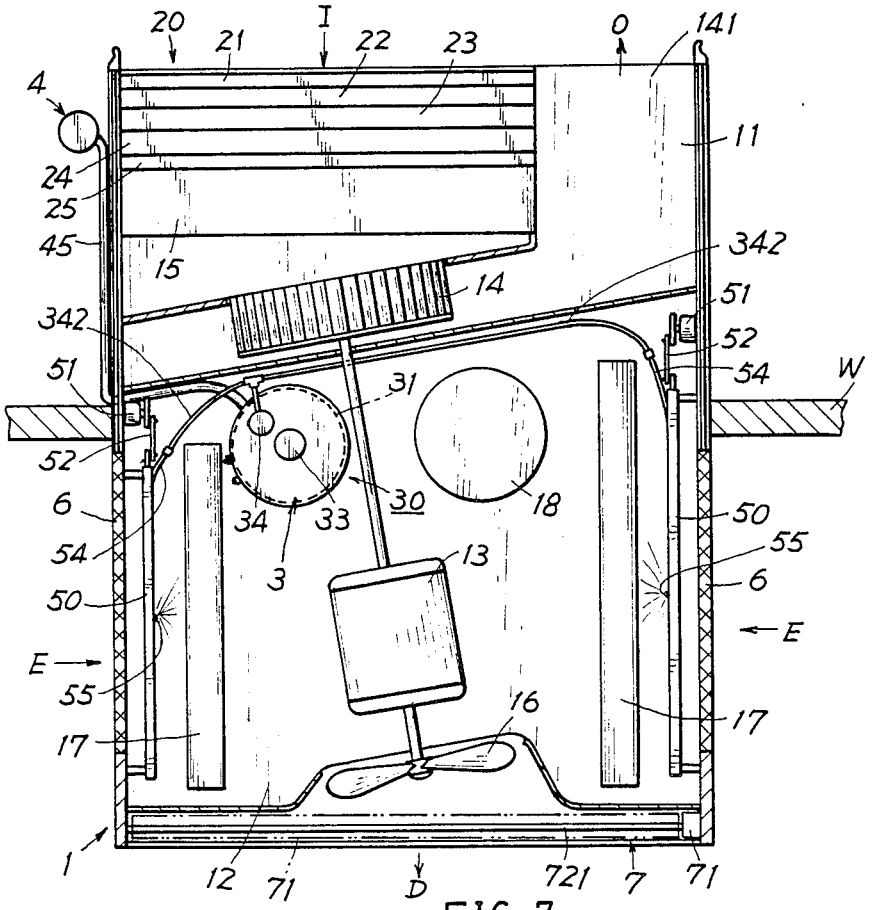
FIG. 7 is a top-view illustration showing another preferred embodiment of the present invention.

As shown in FIG. 7, the condensers are divided into two parts respectivley disposed on two sides of the rear portion 12 so that the discharge pipes 342 and water spraying means 5 should be two sets for cleaning both condenser parts.

Figure 8B:
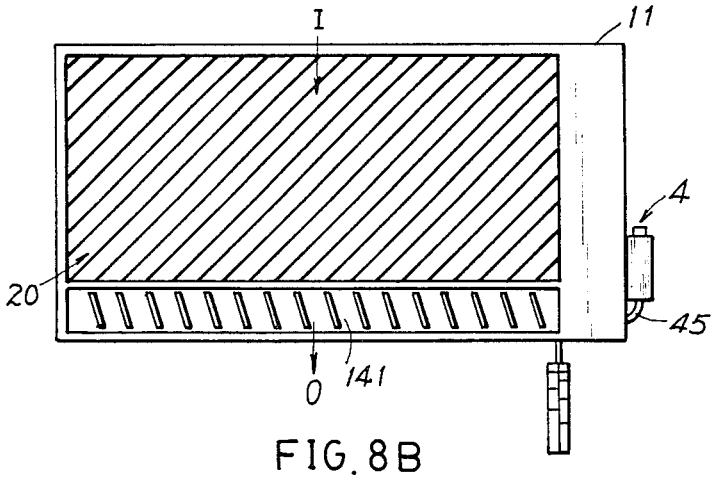
FIG. 8B shows a front portion of the conditioner combinable with the rear portion as shown in FIG. 8A to form an integral air conditioner.
Figure 8:
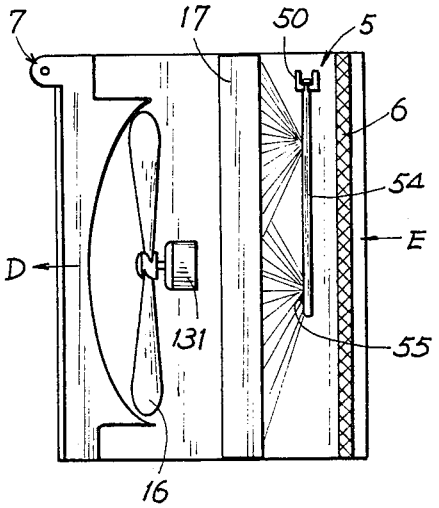
FIG. 8 shows an outside air dust-removing means of a separated rear portion of a conditioner of still another preferred embodiment of the present invention.
Figure 8A:
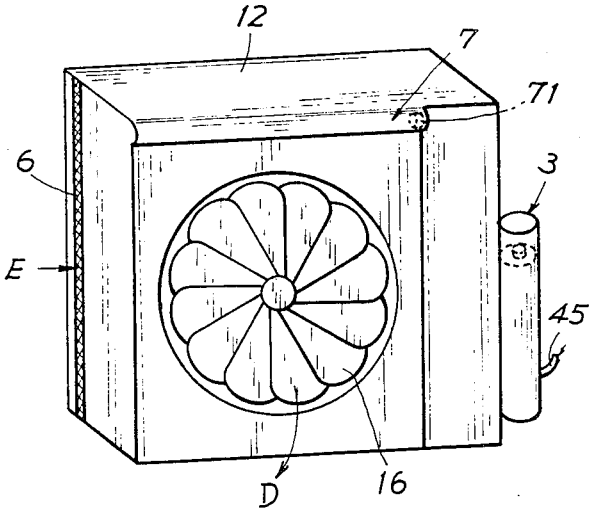
FIG. 8A shows an outer appearance of FIG. 8 in accordance with the present invention.

As shown in FIGS. 8, 8A and 8B, the condenser 17 in the rear portion 12 may be fixed on an outer wall to separate from the front portion 11 installed inside a room.

For better washing purpose, a detergent 40 may be quantitatively applied to the water spray means 5 by depressing the push button 42 of the detergent supplier 4 to allow the detergent liquid to flow and be mixed in the water accumulator 3.

The present invention provides an air conditioner capable of removing dusts, pollutants or odor laden in an interior air, or removing dust in an outdoor air for cleaning an evaporator and a condenser, for circulating a dust-free, deoderized comfortable clean air inside a room or for increasing a cooling effect, but decreasing maintenance problems of the condenser, the evaporator and the relevant elements of the conditioner.

I claim:

1. An air-cleaning air conditioner comprising:

an inside air cleaning means provided in a front portion of an air conditioner set located inside a room or an interior for cleaning air inside the room or interior circulated through an evaporator of the air conditioner set; and an outside air dust-removing means provided in a rear portion of the conditioner set located in an outdoor for precluding dust entrance into the rear portion of the conditioner set;

said inside air cleaning means including a screen formed on a front portion of the air conditioner set for primarily filtering coarse dust particles laden in the air, a non-woven cloth filter formed on a rear side of the screen for filtering fine dust particles, an electrostatic precipitator formed on a rear side of the cloth filter for precipitating finest particles, an oxygen ion producer secured to a rear side of the electrostatic precipitator for producing oxygen anions for human health and for cleaning air, and an activated-carbon filter formed on a rear side of the oxygen ion producer beyond the evaporator for deoderizing a dust-removed air or hazardous gases flowing into the evaporator; and said outside air dust-removing means including a water accumulator collecting a condensate water from a bottom plate of the conditioner set, a detergent supplier supplying quantitative detergent into the water accumulator for mixing the condensate water in said accumulator, a water spraying means connected to said water accumulator and reciprocatively spraying water onto the condenser for cleaning the condenser, a side filter means having two filters detachably formed on two louver-windows on two side portion of the conditioner set for precluding dust laden in outdoor air into the rear portion of the conditioner set, and a rear rolling shield rotatably wound on a spindle driven by a rear motor for extensibly closing a rear discharge port of the conditioner set for precluding the entrance of air pollutants therein.

2. An air-cleaning air conditioner according to claim 1, wherein said water accumulator includes: a lower reservoir recessed in a bottom plate of the conditioner set for collecting condensate water therein having a first low-level controller and a first high-level controller provided therein; an upper tank formed and postioned above said lower reservoir having a first pump pumping the water in the lower reservoir into the upper tank when the water reaches the first high-level controller, having a second low-level controller and a second high-level controller provided in the upper tank, and a second pump for pumping the water in the upper tank to the water spraying means when the water reaches the second high-level controller.

3. An air conditioner according to claim 1, wherein said detergent supplier includes: a detergent container formed on a front portion inside a room for filling detergent liquid therein, a push button having a central stem protruding downwardly from the button which is restored upwardly by an upper spring, a drain hopper formed on a lower portion of the container, and a discharge valve normally sealing the hopper and operatively opened when downwardly depressing the push button to quantitatively discharge the detergent into a delivery pipe connected under said hopper for delivering the detergent into said lower reservoir of said water accumulator.

4. An air conditioner according to claim 3, wherein said discharge valve includes a plug resiliently retained under the hopper by a lower spring held in a plug retainer secured to a lower portion of said hopper, said plug normally sealing a central hole formed in a central lower portion of the hopper and operatively lowered to open the central hole of said hopper for discharging the detergent outwardly when said push button is depressed to lower the central stem, said stem having a pusher plate formed on a bottom end of the stem operatively pressing said plug downwardly to open the central hole.

5. An air conditioner according to claim 1, wherein said water spraying means includes: a flexible water hose connected to a discharge pipe of said water accumulator, having an outermost end of said hose terminated with at least a nozzle and secured to a reciprocating means reciprocatively moving before the condenser for reciprocatively spraying water onto the condenser for cleaning the condenser.

6. An air conditioner according to claim 5, wherein said reciprocating means includes a telescopic link assembly reciprocatively driven by a crank driven by a speed-reducing motor, having an outermost end of the reciprocating means secured with a slider block for fixing the outer end of hose and the nozzle thereon, said slider block having rollers rolling on a first rail of a rail means fixed on a the conditioner set before the condenser, said flexible water hose slidably hanged to a second rail of said rail means by a plurality of hangers.

7. An air conditioner according to claim 1, wherein said air conditioner set includes a bottom frame having a plurality of beads or rollers formed thereon for slidably mounting the conditioner set on a mounting frame.

* * * * *
* * * * *